US005634991A

United States Patent [19]

Kamat

[11] Patent Number: 5,634,991

[45] Date of Patent: Jun. 3, 1997

[54] ALLOY AND METHOD FOR MAKING CONTINUOUSLY CAST ALUMINUM ALLOY CAN STOCK

[75] Inventor: Rajeev G. Kamat, Richmond, Va.

[73] Assignee: Reynolds Metals Company, Richmond, Va.

[21] Appl. No.: 519,471

[22] Filed: Aug. 25, 1995

[51] Int. Cl.[6] ..... C22F 1/04

[52] U.S. Cl. ..... 148/551; 148/552; 148/692; 148/693

[58] Field of Search ..... 148/551, 552, 148/692, 693

[56] References Cited

U.S. PATENT DOCUMENTS

| | | | |
|---|---|---|---|
| 4,282,044 | 8/1981 | Robertson et al. | 148/550 |
| 4,407,679 | 10/1983 | Manzonelli et al. | 148/551 |
| 4,609,408 | 9/1986 | Rodrigues et al. | 148/551 |
| 5,098,490 | 3/1992 | Huu | 148/693 |
| 5,104,465 | 4/1992 | McAuliffe et al. | 148/439 |
| 5,286,315 | 2/1994 | Iwayama et al. | 148/538 |
| 5,356,495 | 10/1994 | Wyatt-Mair et al. | 148/551 |

FOREIGN PATENT DOCUMENTS

| | | | |
|---|---|---|---|
| 2-122055 | 5/1990 | Japan | 148/551 |

OTHER PUBLICATIONS

Dr. Eiki Usui et al., "Age Hardening Behavior of AL–1% MN –1% MG Alloy", Kobelco Technology Review, No. 7, Feb. 1990, pp. 14–17.

T. Inaba et al., "Bake–Hardening Behavior of Aluminum Alloy 3004 and High Strength Can Body Stock", The Minerals, Metals & Materials Society, 1993, pp.227–235.

H. D. Merchant and J. G. Morris, "Textures in Non–Ferrous Metals and Alloys", Non–Ferrous Metals Committee of The Metallurgical Society of AIME, Detroit, Michigan, Sept. 19–20, 1994.

T. C. Sun, J. G. Morris & H. D. Merchant, "Effect of MN Supersaturation On Texture and Earing Behavior of Aluminum Alloys", pp. 79–97.

A. I. Nussbaum, "The 'Golden' Age of Continuous Thin Slab Casting", Light Metal Age, Oct. 1993, pp.6–18.

Wallace D. Huskonen, "Golden Cranks Up San Antonio Mill", Metal Producing, Jul. 1993, pp. 23–28.

J. G. Morris and R. V. Tilak, "The Criticality of Retained Supersaturation Content On Superstrengthening Processes in Aluminum Alloys", Scripta Metallurgica, vol. 19, pp. 587–589, 1985.

Donald McAuliffe and Ivan M. Marsh, "Production of Can Body Stock From Caster II Continuous Cast Strip", Light Metals 1989, The Minerals, Metals & Materials Society, 1988, pp. 739–741.

Lian Chen and J. G. Morris, "The Precipitation Behavior of Strip Cast 3004 Aluminum Alloy", Scripta Metallurgica, vol. 18, pp. 1365–1370, 1984.

Ivan M. Marsh and Don C. McAuliffe, "Development of Continuously Cast High Quality Aluminum Sheet", Light Metal Age, Aug., 1994, pp. 46–48.

Fred L. Church, "Shortcut to Canstock", CanTech International™, Jun./Jul. 1995, pp. 44–49.

(List continued on next page.)

*Primary Examiner*—George Wyszomierski
*Attorney, Agent, or Firm*—Alan M. Biddison

[57] ABSTRACT

A method for making aluminum alloy can stock from continuously cast aluminum alloy slabs includes the steps of continuous casting, hot rolling, hot line annealing, cold rolling, intermediate annealing and cold rolling to final gauge. After the material is cold rolled to final gauge, it is subjected to a heat treatment step which improves its formability. The method is suited for improved AA3000 series type alloys. Besides improved formability, the inventive method also provides increased alpha phase content and low earing percentage for improvements in can manufacture. An improved aluminum alloy product also is disclosed.

23 Claims, 5 Drawing Sheets

OTHER PUBLICATIONS

Lian Chen, J. G. Morris & S. K. Das, "The Effect of Cooling Rate During Casting On the Structure and Mechanical Property Behavior of AA 3004 Aluminum Alloy", Continuous Casting of Non–Ferrous Metals and Alloys, The Minerals, Metals & Materials Society, 1989, pp. 269–284.

S. X. Ding, X. Y. Fan & J. G. Morris, "The Effect of Size and Distribution of Dispersoids On The Recrystallization Behavior of Strip Cast AA3004 Aluminum Alloy", Aluminum Alloys for Packaging, The Minerals, Metals & Materials Society, ©1993, pp. 237–249.

Svein Erik Naess, "Earing and Texture in Strip–Cast 3004 Type Alloys", Aluminum Alloys for Packaging, The Minerals, Metals & Materials Society, ©1993, pp. 275–307.

FIGURE 1: FLOW SHEET OF ONE MODE OF INVENTIVE METHOD
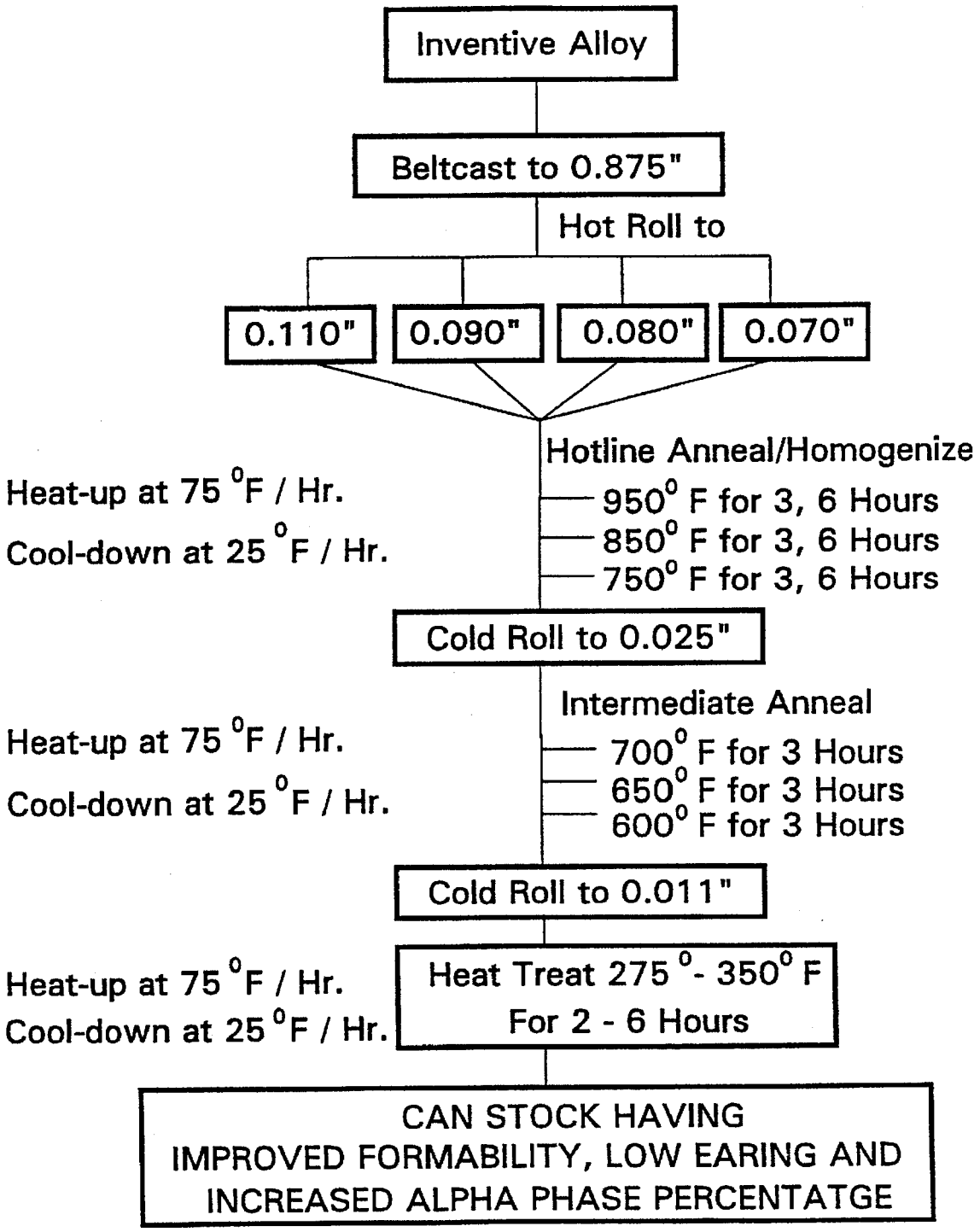

FIGURE 2: BELTCAST FINAL GAUGE HEAT TREAT STRENGTH
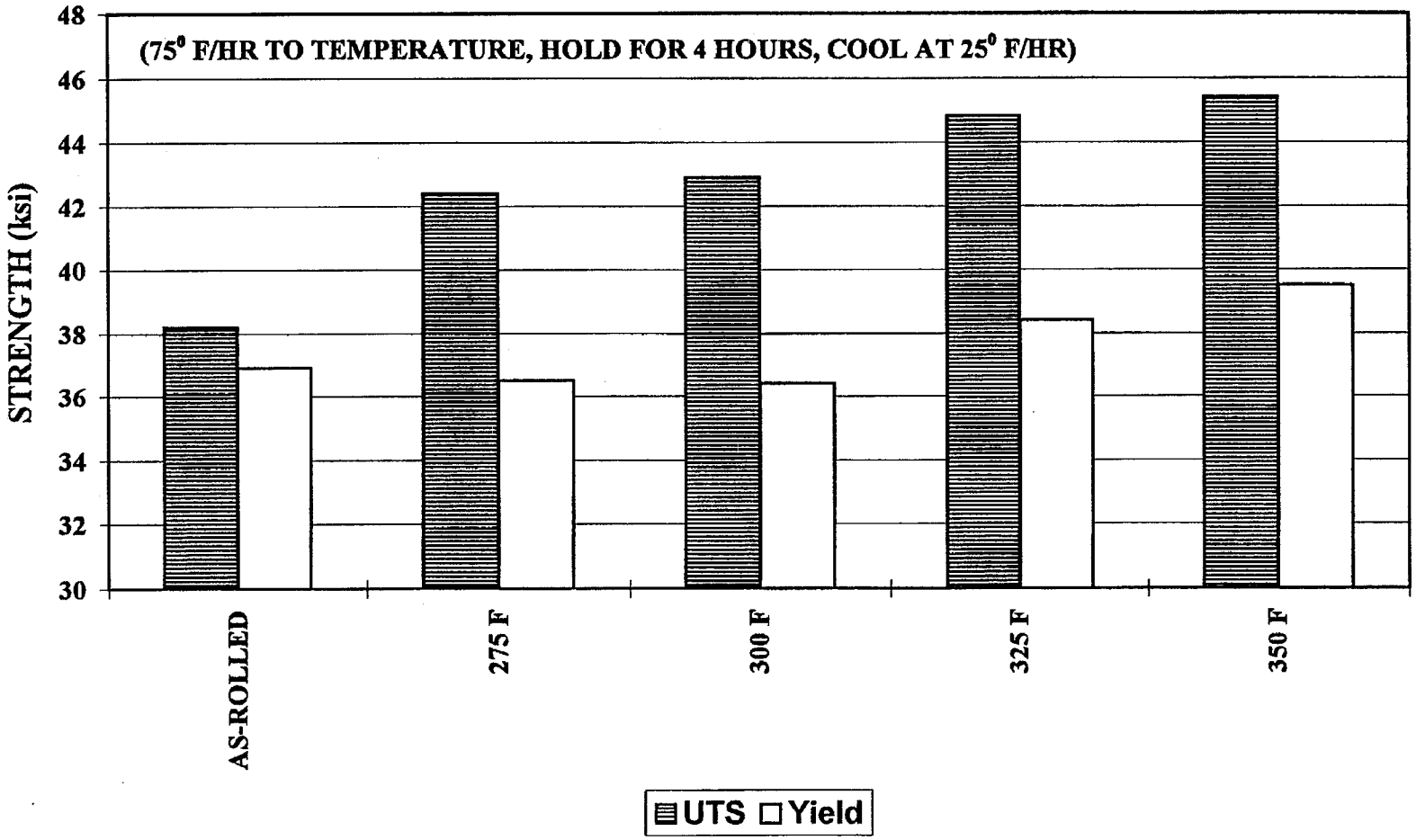

FIGURE 3: FINAL GAUGE STRENGTH AFTER HEAT TREAT AT 350$^0$ F FOR 4 HOURS
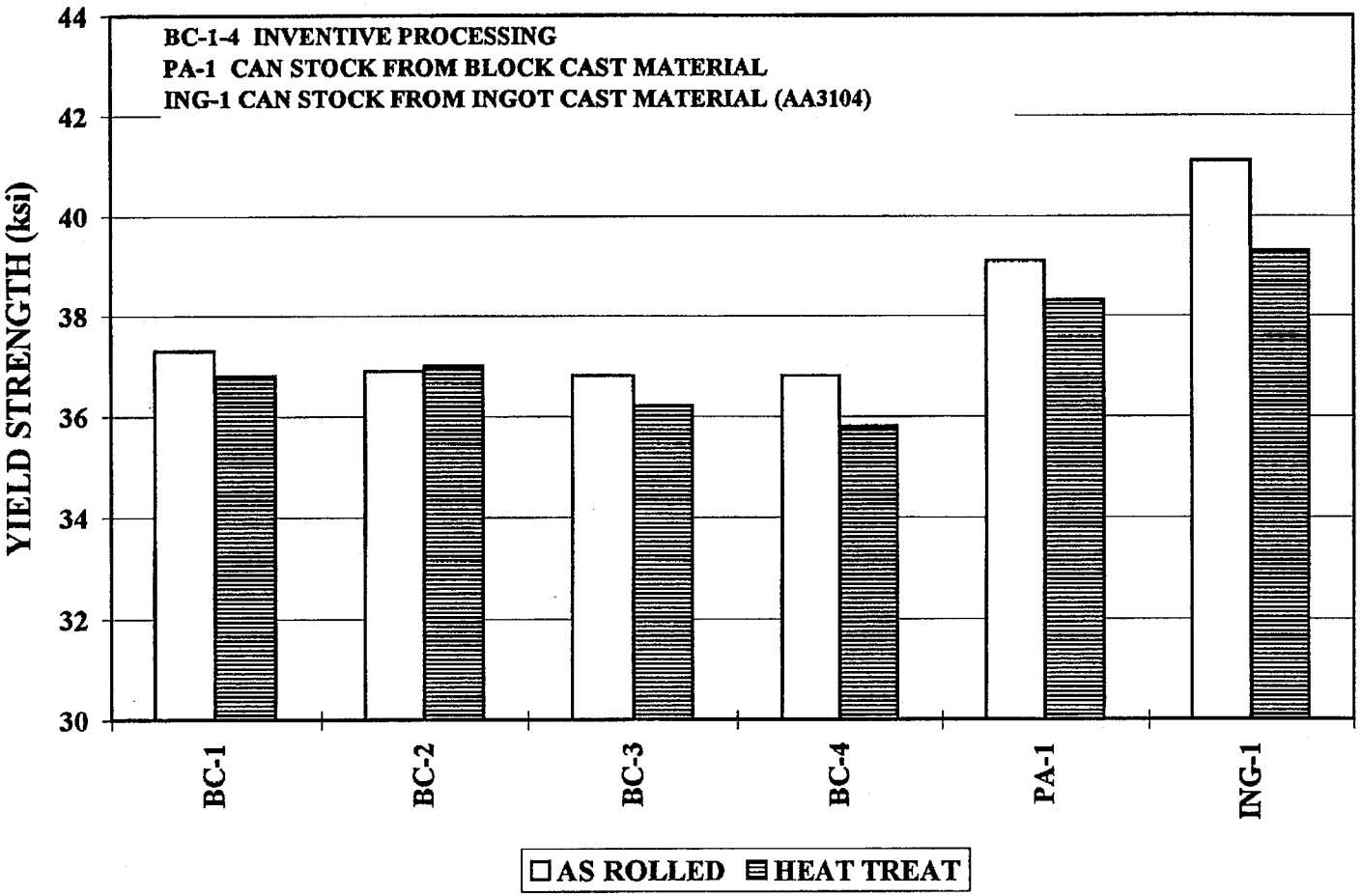

FIGURE 4: FINAL GAUGE STRENGTH AFTER HEAT TREAT AT 350$^0$ F FOR 4 HOURS
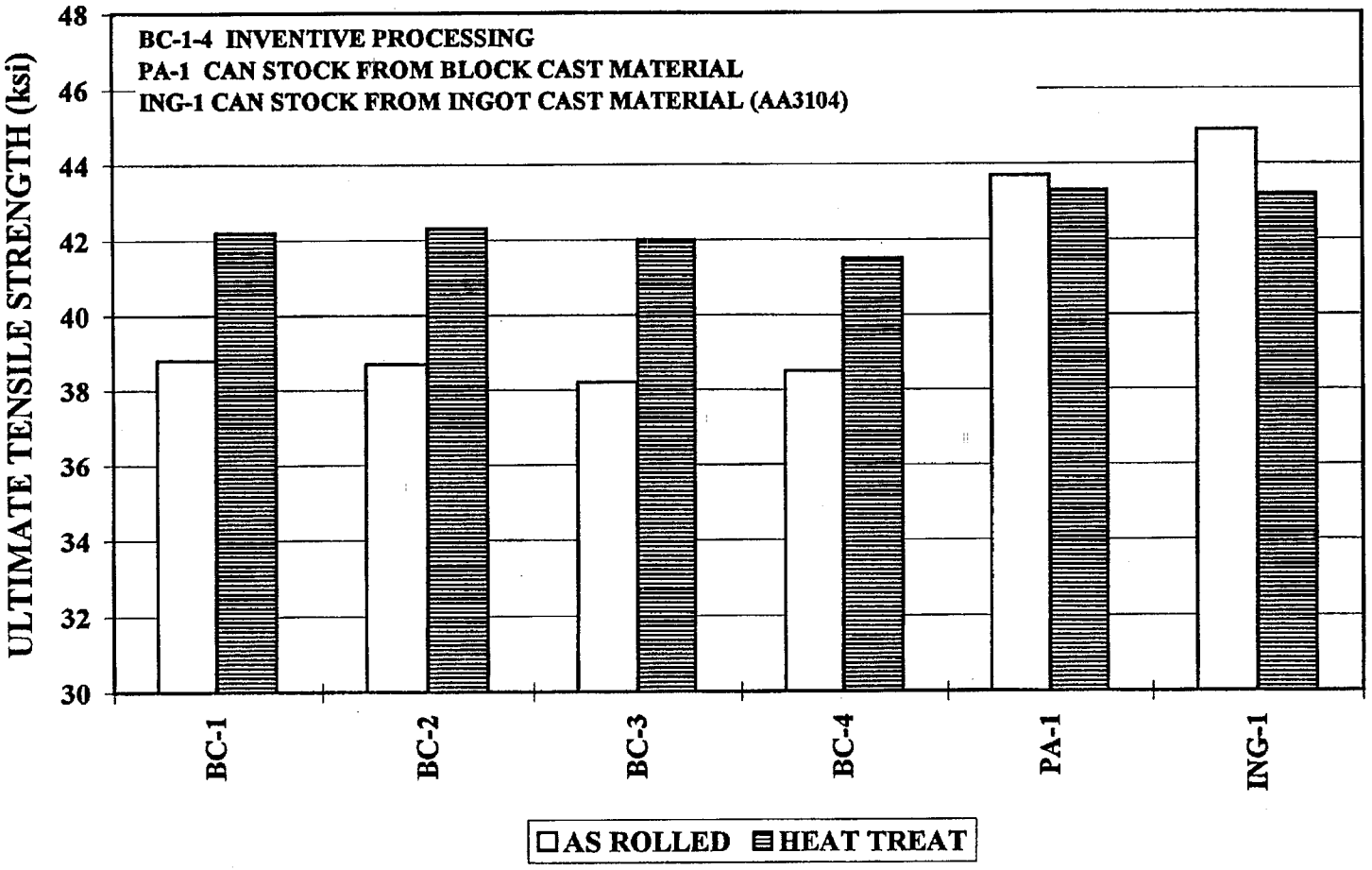

FIGURE 5: FINAL GAUGE EARING COMPARISON
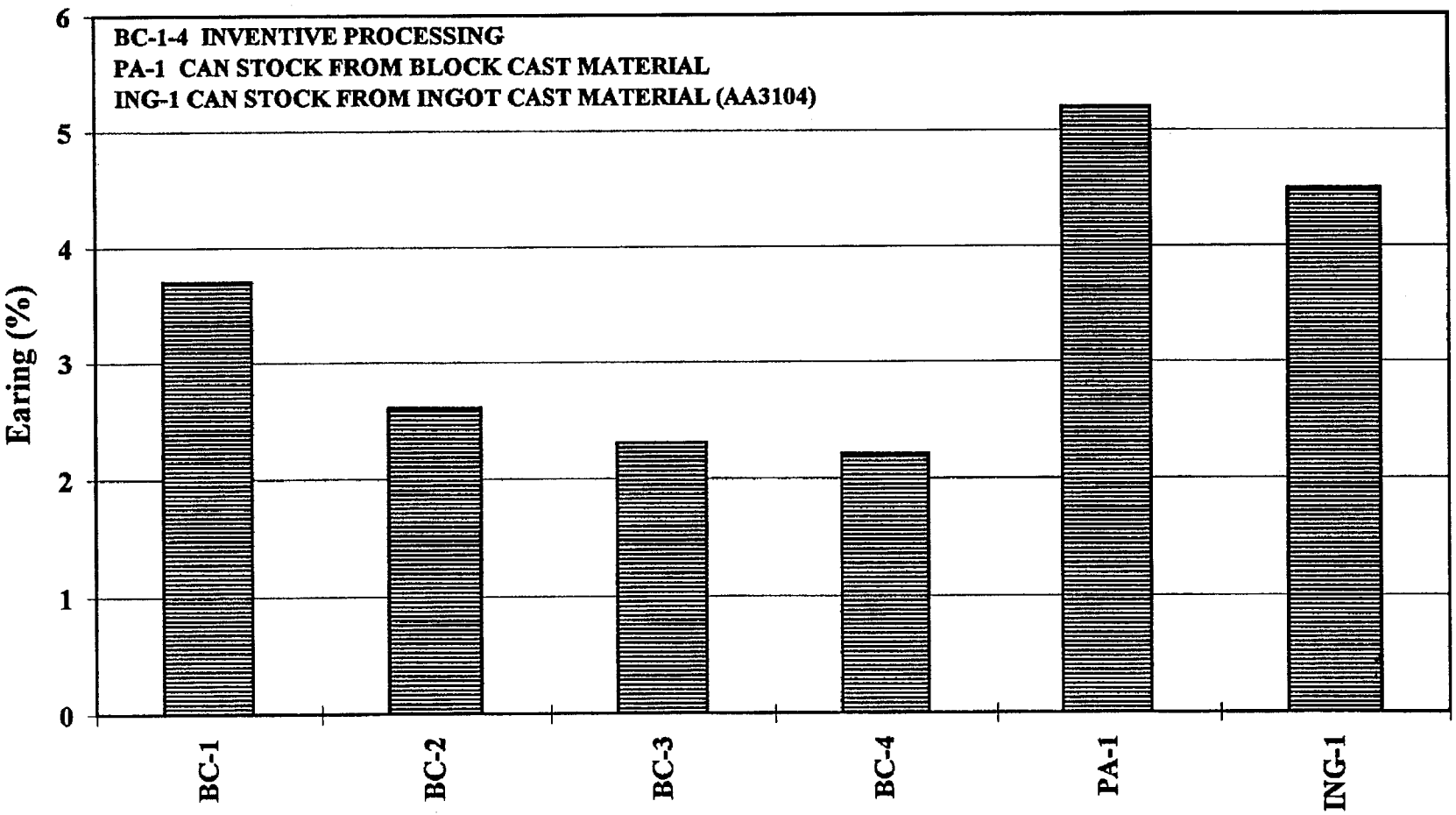

ALLOY AND METHOD FOR MAKING CONTINUOUSLY CAST ALUMINUM ALLOY CAN STOCK

FIELD OF THE INVENTION

The present invention provides an alloy and a method of making continuously cast aluminum alloy sheet product. More specifically, this invention relates to an alloy and sheet product for making aluminum can bodies. Further, the invention provides an alloy and a method utilizing an AA3000 series type alloy which is heat treated after final cold rolling to improve properties, such as to achieve increased formability. The inventive method also provides a product with lower earing and higher alpha phase content.

BACKGROUND ART

In the prior art, it is well known to make aluminum alloy can stock using ingot processing. In these prior art methods, the aluminum alloy is cast into ingot form, homogenized/heated in soaking pits or furnaces and subsequently hot rolled. The hot rolled material is then furnace annealed or self-annealed and cold rolled to can stock final gauge. Can stock derived from ingot casting is beneficial in that the homogenization/soaking pit practice used for cast ingots contributes to increased alpha phase content in the product. Higher alpha phase content is desirable since it improves use of the product in a can making operation and enhances die life by reducing pickup or coating of the ironing dies.

Ingot processing of can stock is disadvantageous for several reasons, such as, the need for an ingot break down rolling mill, the need for increased material handling operations of the ingots, need for scalping ingots resulting in metal loss, intensive energy consumption, product reworking and low yields.

Continuous casting methods have been proposed to overcome the problems associated with ingot processing of can stock. U.S. Pat. No. 5,104,465 to McAuliffee et al. discloses a method of making aluminum sheet for can stock wherein the aluminum sheet is continuously chill block cast. The alloy of the McAuliffee et al patent utilizes higher manganese and magnesium concentrations then those levels in ingot processed can stock, e.g., AA3104. According to this patent, the final cold rolled gauge material is sheared and processed into a finished aluminum can.

Making aluminum alloy can stock from continuously cast material is not without its disadvantages. Typically, earing percentage in continuous cast product is high, the high earing percentage interfering with the drawing and ironing operation of can making, which results in lower productivity and lower yield due to need for greater trimming of cans. Further, these continuously cast materials exhibit poor formability in high cold work tempers as measured by the minimal spread between ultimate tensile strength and yield strength or percent elongation. In addition, the relative percentage of the alpha phase in the can stock is much lower than that found in can stock produced by ingot processing.

Another drawback associated with the prior art is the fact that AA3104/3004 type alloys, which are commonly used for can stock, are limited due to their inherent non-heat treatable nature.

In view of the disadvantages noted above, a need has developed to provide a method for making aluminum alloy continuously cast can stock which has low earing, a high alpha phase percentage and good formability. In response to this need, the present invention provides a method for making aluminum alloy can stock using continuous casting in combination with annealing and cold rolling to final gauge followed by a heat treating step which increases the spread between ultimate tensile strength and yield strength for improved formability.

SUMMARY OF THE INVENTION

It is a first object of the present invention to provide an alloy for making aluminum alloy can stock using the continuous casting process.

Another object of the present invention is to provide a method for making aluminum alloy can stock which has good formability.

Another object of the present invention is to provide a method for making an aluminum alloy can stock wherein the can stock exhibits low eating.

A further object of the present invention is to provide a method of making continuously cast aluminum alloy can stock which exhibits a high percentage of alpha phase.

A still further object of the present invention is to provide a method of utilizing an AA3000 series type alloy which is generally non-heat treatable and processing it after final gauge cold rolling to achieve an increase in ultimate tensile strength for improved formability.

Other objects and advantages of the present invention will become apparent as a description thereof proceeds.

In satisfaction of the foregoing objects and advantages, the present invention provides an alloy and method for making aluminum alloy can stock employing a continuous casting operation, particularly either twin belt or block casting, which produces an aluminum alloy can stock exhibiting low earing, good formability and high alpha phase content.

In one aspect of the invention, the inventive alloy is continuously cast into a slab of about 1" (2.54 cm) in thickness, hot rolled to a hot band gauge in a tandem mill having one or more stands with reductions of 80–95 percent in total, hot line annealed, cold rolled, intermediate gauge annealed and cold rolled to final gauge. The final gauge cold rolled product is then heat treated to achieve improvements in formability by increasing the spread between ultimate tensile strength and yield strength.

The inventive alloy composition consists essentially of in weight percent of 0.12–0.30 silicon, 0.55 maximum iron, 0.30–0.60 copper, 0.60–1.1 manganese, 1.0–1.30 magnesium, 0.05 maximum chromium, 0.25 maximum zinc, 0.04 max titanium with the balance aluminum and incidental impurities. More preferably, the alloy composition, in weight percent, consists essentially of 0.17–0.23 silicon, 0.45 maximum iron, 0.36–0.6 copper, 0.6–1.0 manganese, 1.15–1.25 magnesium, 0.01 maximum chromium, 0.02 maximum zinc, 0.02 maximum titanium, with the balance aluminum and incidental impurities. It should be appreciated that any element specified as a maximum may be present as an impurity, rather than as an intentional alloying element. Further, it may be desirable to limit manganese to a range of 0.70 to 0.85 and to limit copper to a range of 0.40 to 0.55. This also can also be expressed in combination as a ratio of manganese to copper of about 1.5. Further, it may be desirable to limit iron to a maximum of 0.40 and to limit silicon to a range of 0.18 to 0.22 to give a ratio of iron to silicon in the range of about 1.5 –2.0.

Preferably, the hot line annealing or homogenizing treatment is conducted between 750° and 1,000° F. (399°–538° C.) for a few hours, such as 1, 2 or 3 hours, to 10 hours. The intermediate annealing temperature and times range between 600° to 800° F. (316° to 427° C.) for 1 or 2 to 6 hours. The heat up and cool down rates for these annealing steps are conventional, such as in the range of 50°–100° F. (10°–38° C.)/Hr and preferably approximately 75° F. (24° C.)/hour for heat up and 10°–40° F. (5.5°–22° C.)/Hr. range preferably approximately 25° F. (13.9° C.)/hour for cooling. Cooling can be performed under ambient conditions.

The temperatures and times for the final heat treating step range between 250° and 350° F. (121° to 177° C.) for 1 or 2 to 6 hours. Preferably, the minimum temperature is about 275° F. (135° C.), with a target temperature of about 325° F. (163° C.) being desired. The heat up and cool down rates for this heat treating step are similar to those described for the annealing steps.

The inventive alloy and method provides a can stock for can body manufacture which has improved formability, lower earing percentages and increased alpha content percent over known prior art alloys and methods of continuous casting process.

BRIEF DESCRIPTION OF THE DRAWINGS

Reference is now made to the drawings of the invention wherein:

FIG. 1 is a flow sheet of one mode of the inventive method;

FIG. 2 shows the effect of the final gauge heat treatment on yield strength and ultimate tensile strength according to the invention;

FIGS. 3 and 4 are step graphs comparing yield strength and ultimate tensile strength of the inventive alloy and process and for alloys made using prior art processing techniques; and FIG. 5 is a step graph comparing the inventive alloy and process with prior art alloys and processing, with respect to percent earing.

DESCRIPTION OF THE PREFERRED EMBODIMENTS

The present invention offers significant improvements in the art of making aluminum alloy can stock. In one aspect, an AA3000 series-type alloy, typically not heat treatable, is modified in accordance with the invention and continuously cast to provide a product that exhibits significant increases in ultimate tensile strength when heat treated after final gauge cold rolling. This increase in ultimate tensile strength gives significant improvements in formability since the difference between yield strength and ultimate tensile strength exceeds that of other prior art can stock.

In another aspect of the invention, significant improvements are realized in reducing earing percentages as compared with known prior art can stock. Reduction in earing percentage improves the metal yield and productivity when the product is subjected to the drawing and ironing operations employed in the can making process.

In a further aspect of the invention, continuously cast alloy products according to the invention also exhibit significant increases in relative alpha phase content percentages. Consequently, products of the invention, when subjected to the inventive method, exhibit percentages of alpha content comparable to material which is made from ingot. With these increased alpha content percentages, die life and the overall drawing and ironing operations are improved when cans are made from the inventive products.

The alloy and thermomechanical processing provided by the invention are significant in that a continuously cast product gives a combination of low earing percentage, high alpha phase content and improved formability in conjunction with the recognized benefits of making can stock from continuously cast material.

With reference now to FIG. 1, an exemplary mode of the inventive method is depicted in block diagram form. The inventive alloys are described as "AA3000 series-type alloys" because the alloys have compositional ranges that would allow registration of the alloys with the Aluminum Association in the 3000 series of aluminum alloys. The inventive alloy is provided for a processing sequence including continuous casting, hot rolling, hot line annealing/homogenization, intermediate gauge cold rolling, intermediate annealing and final gauge cold rolling. A heat treatment is also provided at final gauge to enhance the formability of the thus produced can stock. In its broadest embodiment, the inventive method should be suitable with any AA3000 series type alloy; however, the method is specially useful with the inventive alloys shown in Table 1. The alloy designations BC-1 through BC-4 represent the four hot band gauges shown in FIG. 1.

Table 2 details specific chemistry for commercially available block cast can stock alloy and ranges for prior art alloys of AA3104 and AA3004, which are typically used in ingot processing as can stock material. As shown in Table 1, the inventive alloy utilizes the beneficial effect of strength increase due to copper. The increased levels of copper result in increased work hardening during the reduction from cast slab to final gauge can stock and in turn improve recrystallization.

Likewise, since it is well known that manganese is a slow diffusing element in aluminum, which interferes with recrystallization, lower levels of manganese contribute to improved recrystallization.

It is also believed that maintaining a 0.45 or lower weight percent maximum iron also contributes to improved recrystallization which provides lower earing percentage. Excessive levels of iron can also interfere with recrystallization.

It is also believed that maintaining a 0.17–0.23 weight percent silicon is necessary to provide increased transformation of beta phase to alpha phase during the hot line anneal.

The inventive alloy used to produce an aluminum slab by continuous casting method results in secondary dendrite arm spacing in the range of 20–40 micrometers. For the prior art method using ingots cast by conventional methods the secondary dendrite arm spacings are in the range of 40–150 micrometers. Dendrite arm spacings decrease with increasing cooling rates such that in general the spacings at the surface will be less than the spacings at the center of a slab or ingot. Smaller secondary dendrite arm spacings such as in continuous cast slabs are preferred because the distances alloying elements have to travel for reducing the segregation during the hot line anneals are shorter and hence shorter times are needed to "homogenize" the slab. Examples of continuous casting methods include twin-belt or block casting. The hot rolling of a continuous cast slab enhances the kinetics of diffusion of elements due to increased dislocation density. Since these casting techniques are well known, further details thereof are not deemed necessary for understanding of the invention. Referring to FIG. 1 again, the aluminum alloy is continuously cast using a twin-belt caster to a slab thickness of 0.875" (22.2 mm). Of course, other slab thicknesses can be utilized as attainable with known continuous casting apparatus.

The continuous cast material is then hot rolled to a hot band gauge. FIG. 1 exemplifies 4 hot band gauges, 0.070"

(1,778 mm), 0.080" (2.032 mm), 0.90" (2.286 mm), and 0.110" (2.794 mm). Again, other hot band gauges could be utilized ranging between the broad limits of 0.05 to 0.25" (1.27 mm to 6.35 mm).

The hot band material is then subjected to a hot line anneal/homogenization. Broadly, the hot line anneal temperature ranges between 750° F. and 1,000° F. (399°–538° C.) for 2 to 10 hours. More preferably, the temperature ranges between 850° F. and 950° F. (427°–510° C.) for 3 to 6 hours. The product also may self anneal if the exit gauge is sufficiently low to provide the necessary deformation and the exit temperature from the hot line is hot enough.

Principally, the hot line anneal/homogenization step provides the following important changes in the alloy:

(a) homogenizes the as-cast structure for removal of microsegregation (conventional ingot processing includes a "true" homogenization typically at temperatures in excess of 1050° F. (565° C.) for soak times of 4–10 hours), (b) provides an optimum size distribution of the submicron size dispersoids (recrystallization in the last annealing step is better for reducing earing), (c) transforms the beta phase $Al_6(FeMn)$ constituents to more desirable alpha phase ($Al_{12}(FeMn)_3Si$) (occurs during homogenization of ingots in conventional processing) for galling resistance, and (d) recrystallizes the deformed metal in preparation for further cold rolling.

The hot line annealed material is then cold rolled to an intermediate gauge, intermediate annealed and cold rolled to a final gauge as shown in FIG. 1. If the gauge of the hot line annealed material is sufficiently thin, the material may be cold rolled to final gauge without an intermediate anneal. The work hardening from the copper may make this difficult. The broad intermediate gauge range is 0.020"–0.040" (0.5–1.0 mm), with a more preferred gauge of 0.025" (0.635 mm) The broad temperature and time ranges for the intermediate anneal are 600° to 800° F. (316° to 427° C.) for 1 to 6 hours with a more preferred range of 675° to 725° F. (357° to 385° C.) for 3 to 4 hours.

FIG. 1 depicts the intermediate annealing for 3 hours at temperatures of 700° F., 650° F. and 600° F. It was found that the annealing for 3 hours at 700° F. provided better results than when the product was annealed for 3 hours at either 650° F. or 600° F.

The heat up and cool down rates for each annealing step shown in FIG. 1 are typical for conventional batch annealing processes. The intermediate anneal according to the invention achieves the requisite balance between recrystallization texture and deformation texture to minimize earing.

Finally, the final gauge cold rolled can body stock is subjected to a heat treating step ranging between about 250° F. (121° C.) or 275° F. (135° C.) and 350° F. (163° C.) for 1 to 6 hours followed by air or ambient cooling. The heat treated final gauge can stock material is suitable for can manufacture since it has improved formability, low earing and an increased alpha phase percentage.

Depending on the temperature of the can body stock after cold rolling, for instance, a temperature of at least 250° F. (121° C.) or higher, the desired heat treating step may be obtained by controlling the rate at which the can body stock is cooled to ambient temperatures. Alternatively, the length of time a heated product is held at temperature is a function of the rate used to heat the product to the desired heat treatment temperature.

It is believed that 350° F. (177° C.) is the upper limit for this heat treatment, temperatures in excess of this value adversely effecting the strength values to a degree where the can stock may not be suitable for use. The heat treating step does not require excessively high solutionizing temperatures (usually associated with heat-treatable aluminum alloys) or any type fast cooling (usually water quench is employed) to keep elements in solution, to achieve precipitation hardening.

Quite surprisingly, this heat treating step results in a significant increase in ultimate tensile strength as compared to the ultimate tensile strength of cold-rolled final gauge material. While not completely understood, the increase in ultimate tensile strength may be related to a precipitation of aluminum-copper-magnesium phase(s) during this heat treating step that provides the hardening effect. The kinetics of such precipitation processes have been known to be enhanced by the presence of dislocations generated during the cold rolling. The dislocations help the elements to diffuse faster as well as act as nucleation sites for the precipitates.

As is known in the art, the difference between yield strength and ultimate tensile strength relates to the formability of can stock material. Can stock having a large difference between these two values is more formable and, thus, more preferred for drawing and ironing steps in can manufacture.

Referring to FIG. 2, a composition falling within the broad range specified in Table 1 is compared in the as-rolled state and after final gauge heat treatment between 275° and 350° F. (135° to 177° C.) for 4 hours. As is evident from this figure, a significant increase in ultimate tensile strength is obtained when heat treating the final gauge cold rolled material. With the significant difference between ultimate tensile strength and yield strength, the heat treated material will exhibit good formability.

FIGS. 3 and 4 compare the alloys defined in Table 1 with the prior art alloys detailed in Table 2 with respect to formability. FIGS. 3 and 4 compare yield strength and ultimate tensile strength, respectively, for the four different compositions BC1–BC4, as set forth in Table 1, and an AA3104 alloy can stock made from ingot, i.e. Ing-1.

As can be seen from FIG. 4, none of the conventional materials exhibited the increase in ultimate tensile strength shown for alloys BC-1–BC-4 when heat treated at 350° F. (177° C.). As shown in FIGS. 3 and 4, a commercially available continuous cast can stock PA-1 shows only about a 4.5 ksi (3.17 kg/m$^2$) difference between ultimate and yield strengths in the as-rolled condition and about 4 ksi (2.81 kg/m$^2$) difference when heat treated for 350° F. (177° C.) for 4 hours. In contrast, for example, BC-3 exhibited less than 2 ksi (1.40 kg/m$^2$) difference in the as-rolled condition and almost 6 ksi (4.22 kg/m$^2$) difference between ultimate tensile strength and yield strength after heat treating.

Similar results were found when these materials were compared for a heat treatment temperature of 325° F. (163° C.) for 4 hours. It also has been found that the length of time between cold rolling and heat treating can impact the response to heat treating.

Besides improved formability, the present invention also provides an aluminum alloy can stock having lower earing. Referring to FIG. 5, a comparison is again made between the inventive alloys BC-1–BC-4, commercially available continuously cast can stock, and ingot processed material. The inventive alloy and processing exhibit significantly lower earing percentage then the commercially available continuous cast can stock material. This improved that is, lower earing percentage is believed to be a result of the combination of hot line annealing, cold rolling, recrystallization annealing, and cold rolling of the inventive alloy. During cold rolling the metal develops crystallographic texture of the deformation type which results in four ears at 45°, 135°, 225° and 315° (along the can rim) with reference to the rolling direction. Annealing results in crystallographic texture of the recrystallization type which develops four ears at 0°, 90°, 270° and 360°. As can be seen these two types of ears are positioned to fill each others valleys. Thus, the intermediate anneal recrystallization texture balances the cold rolling texture to give an overall reduced earing percentage. The alloy composition cooperates with the processing to provide an improved product. Improvements are also seen when comparing the alloy material processed according to the invention with the can stock made from ingot.

Beside improvements in earing percentage and formability, the present invention also provides significant increases in the relative percentage of alpha phase content. Referring now to Table 3, alpha phase relative percentages are compared for 3 different hot line anneal temperatures for the alloy designation BC-1, a can stock from ingot and a can stock from commercially available continuously cast material. As is evident from Table 3, the alpha phase relative percentage according to the inventive processing compares favorably with percentages for ingot cast material and is far in excess of the alpha phase relative percent for commercially available continuously cast can stock. With a minimum preferred value of about 20% alpha phase for successful drawing and ironing operations and extended die life, can stock processed according to the invention meets can manufacturing industry targets in this regard. Thus, making aluminum alloy cans using can stock processed according to the invention will avoid or minimize the galling problems that may occur with alloys having lower alpha phase content.

Also surprising is the level of alpha phase content in a material which is continuously cast. Typically, can stock from ingot materials has high alpha contents due to the homogenization practices in soaking pits employed prior to subsequent hot rolling. The high temperature (in excess of 1050° F.) and long times (4–10 hours at temperature) used in soaking pit practice causes sufficient transformation of the beta phase to the alpha phase in the ingot processed material.

In continuous casting, high alpha phase amounts are not expected since the continuous cast material is not subjected to homogenization practices that are typically used in ingot processing. Moreover, the solidification rates in continuous casting are higher than for conventional ingot casting. Generally, high solidification rates do not assist in development of the alpha phase in the as-cast state. However, according to the invention, continuously cast inventive alloy can stock is produced which exhibits levels of alpha phase content comparable to ingot derived can stock. Thus, can stock can be manufactured more economically without compromising the can stock characteristics needed for can manufacture.

As such, an invention has been disclosed in terms of preferred embodiments thereof which fulfill each and every one of the objects of the present invention as set forth hereinabove and provides an improved method for making aluminum alloy can stock.

TABLE 1

Chemistries (in Wt. %) of the Inventive Alloys

| | Si | Fe | Cu | Mn | Mg | Cr | Zn | Ti |
|---|---|---|---|---|---|---|---|---|
| 1 (0.070") | 0.21 | 0.44 | 0.55 | 0.74 | 1.20 | <.01 | <.01 | 0.01 |
| 2 (0.080") | 0.20 | 0.39 | 0.54 | 0.73 | 1.20 | <.01 | <.01 | 0.01 |
| 3 (0.090") | 0.20 | 0.38 | 0.52 | 0.74 | 1.20 | <.01 | <.01 | 0.01 |
| 4 (0.110") | 0.20 | 0.38 | 0.53 | 0.76 | 1.20 | <.01 | <.01 | 0.01 |

TABLE 2

Block Cast and Ingot Processed Product Chemistries (in Wt. %)

| | Si | Fe | Cu | Mn | Mg | Cr | Zn | Ti |
|---|---|---|---|---|---|---|---|---|
| PA-1 | 0.23 | 0.58 | 0.41 | 1.1 | 1.2 | .02 | .04 | 0.03 |
| AA3104 | 0.6 | 0.8 | 0.05– | 0.8– | 0.8– | — | 0.25 | 0.10 |
| (Ingot) | max | max | 0.25 | 1.4 | 1.3 | | max | max |
| AA3004 | 0.3 | 0.7 | 0.25 | 1.0– | 0.8– | — | 0.25 | — |
| (Ingot) | max | max | max | 1.5 | 1.3 | | max | |

TABLE 3

Alpha Phase Comparison of Block Cast and Ingot Processed Product with Inventive Product

| Alloy | BC1 Alloy | | | | | | | |
|---|---|---|---|---|---|---|---|---|
| Temp. (F.) | 950 | | 850 | | 750 | | Ingot | Block |
| Time (Hrs.) | 3 | 6 | 3 | 6 | 3 | 6. | 3104 | Cast |
| Alpha Phase Relative % | 23.2 ± 2.7 | 28.2 ± 4.8 | 18.3 ± 3.3 | 22.7 ± 2.5 | 14.9 ± 2.7 | 23.0 ± 2.4 | 20–40 | 13.0 ± 2.5 |

Of course, various changes, modifications and alterations from the teachings of the present invention may be contemplated by those skilled in the art without departing from the intended spirit and scope thereof. Accordingly, it is intended that the present invention will only be limited by the terms of the appended claims.

What is claimed is:

1. A method of making improved can stock from continuously cast aluminum alloy slab comprising the steps of:

providing a can stock alloy to be cast;

continuously casting said alloy into slab form;

hot rolling said slab form to form a hot band;

hot line annealing said hot band;

cold rolling said hot band to produce an intermediate gauge product;

annealing said intermediate gauge product;

cold rolling said annealed intermediate gauge product to a final gauge strip product; and heat treating said final gauge strip product at a temperature not greater than 350° F.; and cooling said heat treated strip product to form said improved can stock, said improved can stock having increased formability as a result of the heat treating increasing a difference between yield strength and ultimate tensile strength.

2. The method of claim 1 wherein said alloy is continuously block or belt cast.

3. The method of claim 1 wherein said hot line annealing ranges between 2 and 10 hours at a temperature between 750° and 1,000° F.

4. The method of claim 1 wherein an approximately 75° F./hour heat up rate and an approximately 25° F./hour cool down rate is used for each annealing step and said heat treating step.

5. The method of claim 1 wherein said slab form is hot rolled to a hot band gauge between 0.070 and 0.110 inches.

6. The method of claim 1 wherein said can stock alloy, in weight percent, consists essentially of 0.12–0.30 silicon, 0.30–0.60 copper, 0.70 to 1.00 manganese, 1.1–1.30 magnesium, 0.50 maximum iron, 0.05 maximum chromium, 0.25 maximum zinc, 0.05 maximum titanium, with the balance aluminum and incidental impurities.

7. The method of claim 6 wherein said manganese ranges between 0.73 to 0.76, said copper ranges between 0.50 and 0.55.

8. The method of claim 1 wherein said annealing intermediate gauge product comprises annealing between 600° and 800° F. for 2 to 6 hours.

9. The method of claim 8 wherein said annealing said intermediate gauge product comprises annealing between 675° F. and 725° F. for 3 to 4 hours.

10. The method of claim 1 wherein said heat treating comprises heating said final gauge strip product between 275° and 350° F. for about 1 to 6 hours.

11. A method of making can stock from continuously cast aluminum alloy slab with increased alpha phase content comprising the steps of:

providing an aluminum alloy having copper, manganese, and magnesium as major alloying elements;

continuously casting said alloy into slab form;

hot rolling said slab form to form a hot band;

hot line annealing said hot band between 750° and 1000° F. for a time between 3 and 10 hours to increase alpha phase content therein;

cold rolling said hot band to provide a final gauge strip product;

heat treating said final gauge strip product between 275° and 350° F. for about 2 to 6 hours; and cooling said heat treated final gauge strip product to provide can stock with said increased alpha phase content.

12. The method of claim 11 wherein said AA3000 series type aluminum alloy consists essentially of in weight percent 0.17–0.23 silicon, 0.36–0.60 copper, 0.70 to 0.85 manganese, 1.15–1.25 magnesium, 0.40 maximum iron, 0.01 maximum chromium, 0.02 maximum zinc, 0.02 maximum titanium with the balance aluminum and incidental impurities.

13. The method of claim 11 wherein said manganese ranges between 0.73 to 0.76, said copper ranges between 0.50 and 0.55.

14. The method of claim 11 wherein said hot line annealing step temperatures and times range between 800° and 950° F. and 3 to 6 hours.

15. The method of claim 11 wherein an approximately 75° F./hour heat up rate and an approximately 25° F./hour cool down rate is used for each annealing step and said heat treating step.

16. The method of claim 11 wherein said cold rolling step further comprises:

cold rolling said hot band to an intermediate gauge product;

annealing said intermediate gauge product between 600° and 800° F. for 2 to 6 hours; and cold rolling to said final gauge strip product.

17. The method of claim 16 wherein the intermediate annealing temperature and time ranges are between 675° F. and 725° F. and 3 to 4 hours.

18. A method of making can stock from continuously cast aluminum alloy slab with a low earing percentage comprising the steps of:

providing an an aluminum alloy having copper, manganese, and magnesium as major alloying elements;

continuously casting said alloy into slab form;

hot rolling said slab form to form a hot band;

hot line annealing said hot band between 750° to 1000° F. for 3 and 10 hours;

cold rolling said annealed hot band to an intermediate gauge product;

recrystallizing annealing said intermediate gauge product;

cold rolling said annealed intermediate gauge product to a final gauge strip; and heat treating said final gauge strip between 250° and 350° F. for about 2 to 6 hours followed by cooling;

wherein said can stock has said low earing percentage.

19. The method of claim 18 wherein said AA3000 series type aluminum alloy consists essentially of in weight percent 0.17–0.23 silicon, 0.36–0.60 copper, 0.70 to 0.85 manganese, 1.15–1.25 magnesium, 0.40 maximum iron, 0.01 maximum chromium, 0.02 maximum zinc, 0.02 maximum titanium with the balance aluminum and incidental impurities.

20. The method of claim 18 wherein said manganese ranges between 0.73 to 0.76, said copper ranges between 0.50 and 0.55.

21. The method of claim 18 wherein an approximately 75° F./hour heat up rate and an approximately 25° F./hour cool down rate is used for each annealing step and said heat treating step.

22. The method of claim 18 wherein said recrystallizing annealing step further comprises annealing between 600° and 800° F. for 2 to 6 hours.

23. The method of claim 22 wherein the annealing temperature and times ranges are between 675° F. and 725° F. and 3 to 4 hours, respectively.

* * * * *